United States Patent [19]

Burley

[11] Patent Number: 4,927,134

[45] Date of Patent: May 22, 1990

[54] DASHER BOARD SYSTEM

[75] Inventor: John S. Burley, Salix, Pa.

[73] Assignee: Burley's Ring Supply, Salix, Pa.

[21] Appl. No.: 395,361

[22] Filed: Aug. 17, 1989

Related U.S. Application Data

[62] Division of Ser. No. 214,433, Jul. 1, 1988, Pat. No. 4,883,267.

[51] Int. Cl.[5] ..... E04H 17/16

[52] U.S. Cl. ..... 272/3; 256/24; 256/25; 256/73; 292/26; 292/237

[58] Field of Search ..... 272/3–5; 256/24–27, 73; 292/26, 30, 48, 53, 237

[56] References Cited

U.S. PATENT DOCUMENTS 559,296 4/1896 Lewis ..... 292/26
572,485 12/1896 Hays ..... 292/53
1,360,040 11/1929 Slauson ..... 292/48 X
3,883,120 5/1975 Tippmann ..... 272/3 X

FOREIGN PATENT DOCUMENTS 477311 7/1915 France ..... 292/237
191498 11/1937 Switzerland ..... 292/237

*Primary Examiner*—Richard E. Chilcot, Jr.
*Attorney, Agent, or Firm*—Fidelman & Wolffe

[57] ABSTRACT

An ice rink dasher board system having an adjustable shock absorbing mechanism for providing a desire degree of resiliency of the dasher board panels is disclosed. The dasher board system may also have a rink seal gasket located between the dasher board frame and the dasher board panels, the gasket extending beneath the system to permit installation of the system even or uneven surfaces. The dasher board system may also include a door having a push-button latch that can be actuated from either side of the door.

5 Claims, 8 Drawing Sheets

DASHER BOARD SYSTEM

This application is a divisional of Ser. No. 214,433 filed July 1, 1988 now U.S. Pat. No. 4,883,267.

BACKGROUND OF THE INVENTION

The present invention is directed to an ice rink dasher board system. Conventional dasher boards surrounding the ice surface of an ice rink fail to provide a mechanism for minimizing injury when a skater contacts the boards. Such contact is of course typical in the game of hockey, as players may be checked into the boards with great force, often resulting in injury.

One earlier attempt to increase skaters' safety can be seen in Swiss Patent No. 645,275. This patent discloses hockey barrier supports having a resilient pad placed between a base plate and a mounting plate to reduce the number of injuries to skaters and the cooling system. However, this system is inadequate in that it does not provide for varying degree of flexibility of the dasher boards.

In addition, it has been common practice in the industry to use the laborious and somewhat inadequate method of applying a silicone-type caulking to the juncture between the dasher boards and the concrete rink floor to prevent seepage of water beneath the dasher boards. Water seeping under the dasher boards can cause significant damage to the ice rink furnishings and the like. Further, because such caulking materials have such an extreme coefficient of expansion, the vast temperature differential between the time of installation of the caulking and the time of operation of the rink, causes the caulking material to contract, thus causing the seal to fail.

Typically, egress doors are located as required around the rink perimeter. These doors may offer directional egress to key facility interior rooms, such as concession areas, locker rooms, and skate changing areas. It has been standard practice to provide these doors with a bevy of heavy duty steel latches to securely fix the door in its closed position. To avoid potential injury to a skater, the ice rink side of the dasher boards must be smooth. Thus, any handles or latches are located outside of the ice rink and are inaccessible to the skaters.

Not only is this inconvenient for the skaters, who must rely on the ice rink staff to let them off the ice, it creates a serious fire hazard. The typical skating session may involve up to 2,000 persons on the ice sheet. In an emergency situation, these people must wait for a staff member or spectator to open the door.

Some dasher board manufacturers, forced by local fire code enforcement, have installed standard latching hardware with a hole drilled through the handrail. A cable running through the hole with a large pull ring can be used to actuate the latch mechanism from the ice sheet side of the dasher boards. Yet this arrangement sacrifices skater safety in another way, in that the ring may catch clothing, fingers, etc. and cause serious injury. Moreover, the latch can be inadvertently released by contact during a hockey game, for example, thus opening the door at an undesirable time.

In order to reduce maintenance and cleaning, dasher board manufacturers have attempted to use high density polyethylene materials as various components of the dasher board system. Several dasher board manufacturers have mounted polyethylene sheets to a steel frame, although the resulting structure suffered from poor performance. In order to improve hockey puck rebound, a ¾ inch thick standard exterior grade pre-facing has been applied to the polyethylene.

Unfortunately, standard grade plywoods exposed to the high moisture conditions encountered in ice arenas are subject to rapid deterioration through water absorption, rot, mold, mildew, etc. Additionally, cleaning and painting of the plywood, non-ice side of the dasher boards presents a large project and substantial expense for ice arena maintenance crews several times each year.

SUMMARY OF THE INVENTION

The present invention overcomes the above disadvantages by providing a dasher board system with a shock absorbing element anchoring the dasher board supports to the rink floor for controlling the degree of resiliency of the dasher board panels. These shock absorbing elements are adjustable to accommodate various levels of skating. For example, the dasher boards can be made less flexible for more advanced levels of hockey, when a truer deflection of the hockey puck from the boards is more important than it is for junior level play. This also helps prevent the glass from popping out of the frame, since the degree of flexibility of the boards can be adjusted depending on the size and weight of the skaters. In this way, the present invention minimizes, or even prevents, injury to the skaters and reduces the wear and tear oh the ice rink itself.

The dasher board system of the present invention may also include a rink seal gasket disposed between the dasher board support framework and the dasher boards panels. The gasket preferably has inwardly and outwardly extending flanges that are disposed between the ice rink floor and the lower edge of the dasher board panels and between the ice rink floor and the base portion of the framework, in order to permit installation of the present dasher boards system even on uneven surfaces. The rink seal gasket of the present invention eliminates the need for annual caulking while providing a permanent water-tight seal. Moreover, the seal can be maintained even when the flexibility of the dasher boards is altered.

The dasher board system of the present invention may also include a specially designed door with a pushbutton latch mechanism. The mechanism is located so that it can be actuated by a person either on or off the ice, while at the same time, the integrity of the smooth, ice rink side of the dasher boards is maintained, thus preventing injury to the skaters.

BRIEF DESCRIPTION OF THE DRAWINGS

The above aspects of the dasher board system of the present invention can be seen from the following drawings, in which.

DETAILED DESCRIPTION OF THE PREFERRED EMBODIMENTS

Figure 1:
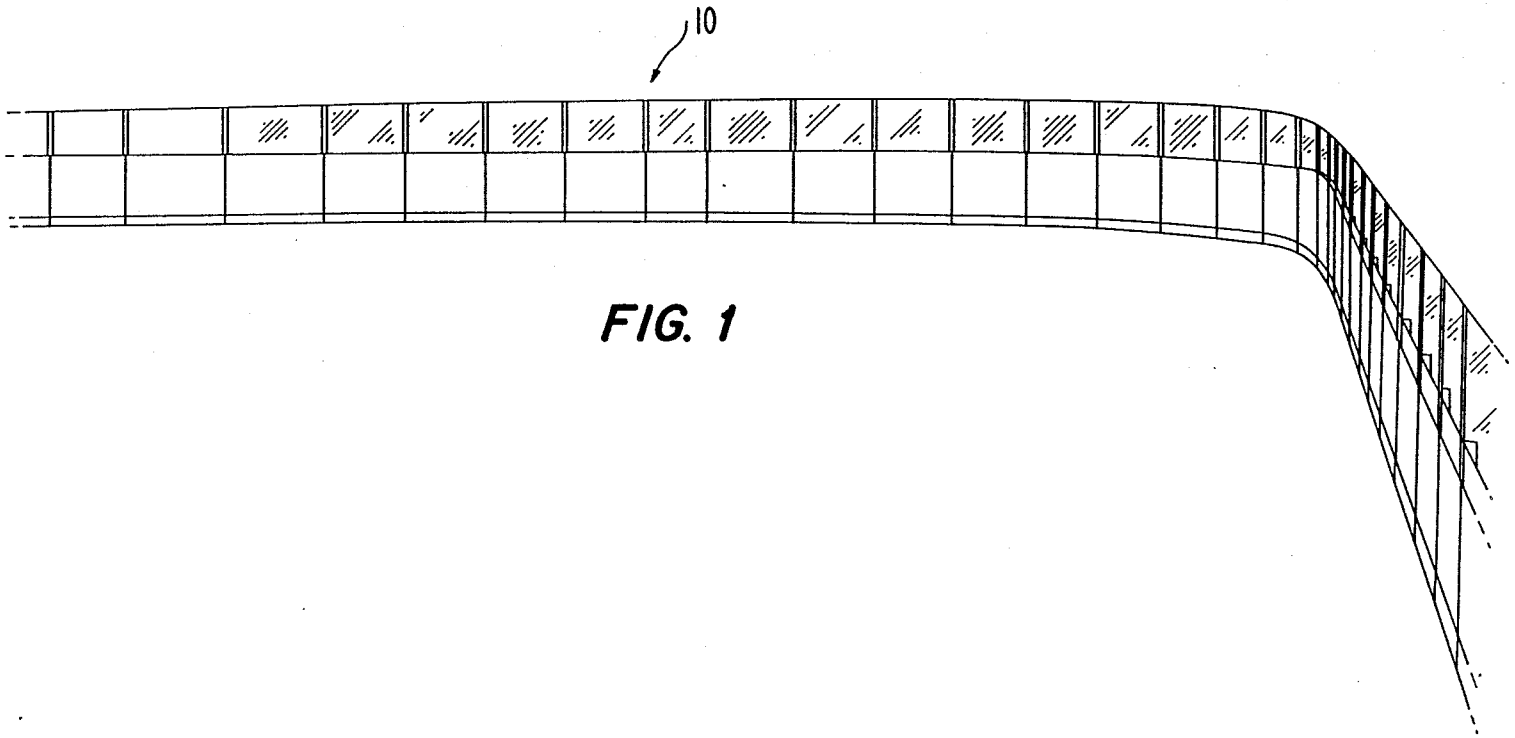
FIG. 1 is an overall perspective view of the dasher board system of the present invention.
Figure 2:
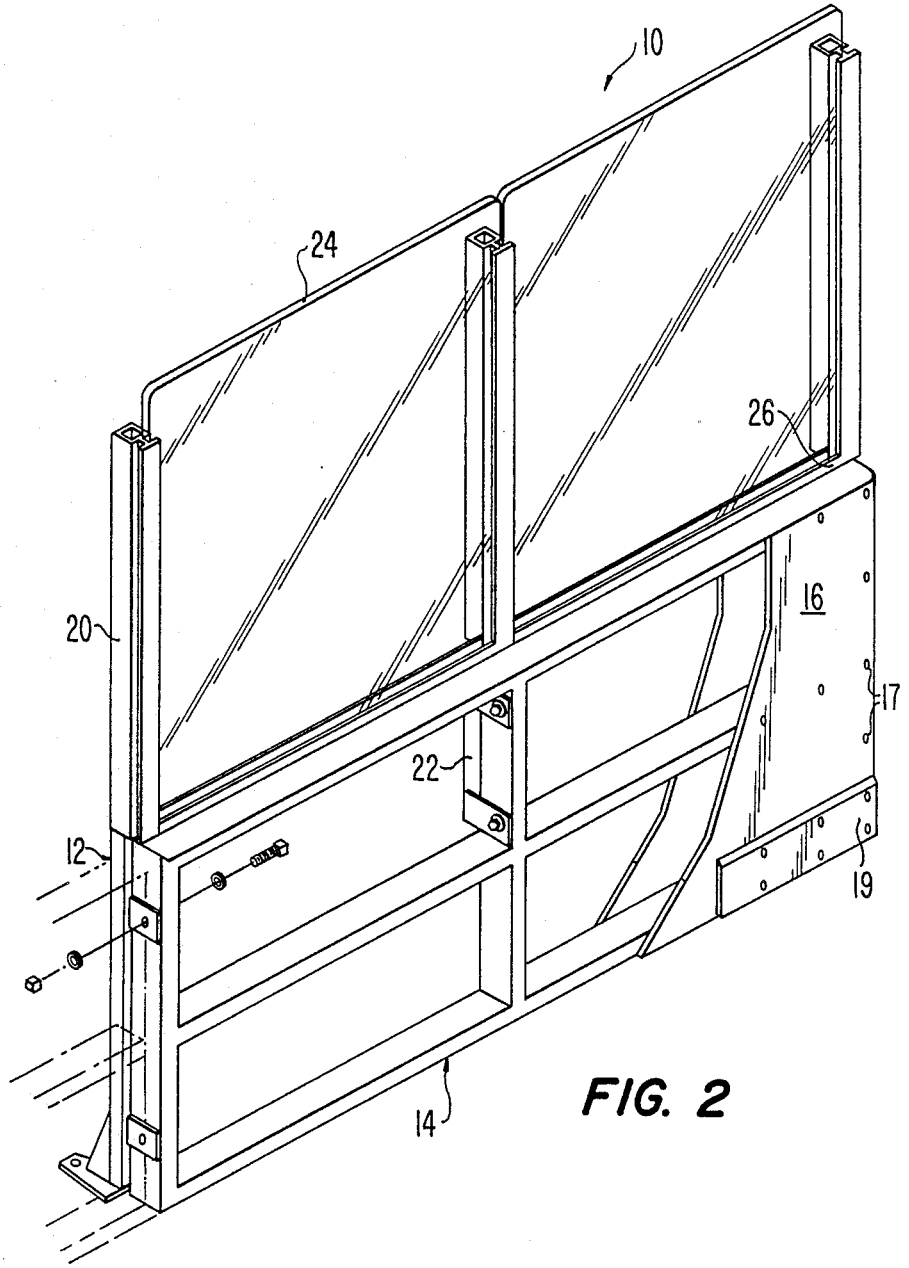
FIG. 2 is a more detailed perspective view of one of the dasher board segments of the system shown in FIG. 1.

A preferred embodiment of the dasher rink system in accordance with the present invention is shown generally in FIG. 1 and designated 10. As is shown clearly in FIG. 2, dasher system 10 includes a plurality of main supports 12 anchored, in a manner to be discussed in detail below, around the periphery of the ice rink.

Frame segment 14 is attached between each adjacent pair of main supports 12. Frame segment 14 is preferably made of steel tubing plated for long life. Each frame segment 14 is fastened, preferably bolted, to the adjacent frame segment to form a continuous framework around the periphery of the ice rink.

Dasher board facing panel 16 is fixed to the front of each frame segment 14, i.e, facing the ice. The facing panel is preferably fastened to the frame segments by screw fasteners 17. Of course, any suitable fasteners may be used.

Facing panel 16 may be multilayered. In one preferred embodiment, an inner layer of approximately 1/16 inch thick polyethylene, a middle layer of ¾ inch thick pressure treated plywood and an outer layer of ¼ inch thick polyethylene is used. This process of first applying the 1/16 inch thick polyethylene sheet, prior to the ¾ inch pressure treated plywood prefacing permits all plywood to be protected from both sides. The extremely long life of pressure treated plywood in conjunction with the easily maintainable high density polyethylene eliminates the difficulties encountered with the prior art.

Optional backing layer 18, preferably made of polyethylene, may be applied to the rear side of each frame segment 14. This backing layer helps maintain a neat appearance of the dasher board system with little maintenance. Additionally, optional kickplate 19 may be fastened in any suitable manner along the lower portion of facing panel 16.

An upright 20 is fixed to each main support 12. Further, a glass support 22 is fixed, in any suitable manner, to each frame segment 14. Upper shielding protection cushions (not shown) may be placed on the uprights and glass supports to protect the skaters from injury when contacting these surfaces. Uprights 20 and glass supports 22 secure shield panels 24 to the frame segments, so that each frame segment 14 preferably accommodates two shield panels 24. Shield panels 24 may be made of any suitable material, such as acrylic, tempered glass or the like. Channel 26 is provided longitudinally along the upper surface of each frame segment 14 to prevent the shield panels from deflecting when hit.

Figure 3:
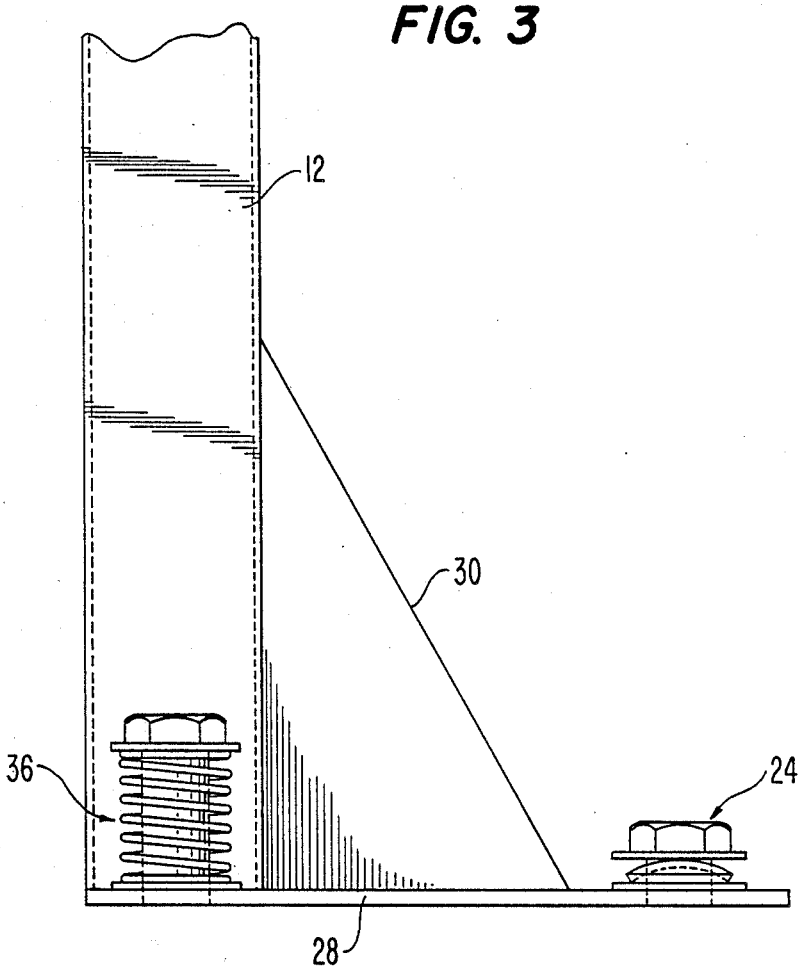
FIG. 3 is a side elevational view of the flex adjustment means of the system shown in FIG. 1.

The manner of attachment of main supports 12 to the rink floor is particularly illustrated in FIGS. 3–5 and will now be described in detail. The lower end of main support 12 is preferably integrally connected to base plate 28 and brace 30. Base plate 28 has openings 32 formed therein for accommodating fastener elements.

In a preferred embodiment, base plate 28 is triangularly-shaped and has an opening 32 formed at each corner thereof. Fastener 34 is received within one of the openings 32 and fixes the apex of base plate 28 to the rink floor, while fasteners 36 are fitted within the remaining two openings 32 to fix the other two corners of the base plate to the rink floor. Fastener 34 preferably includes bolt 44 and spring washer 46. Optional washers 48 may be used as needed.

Figure 4:
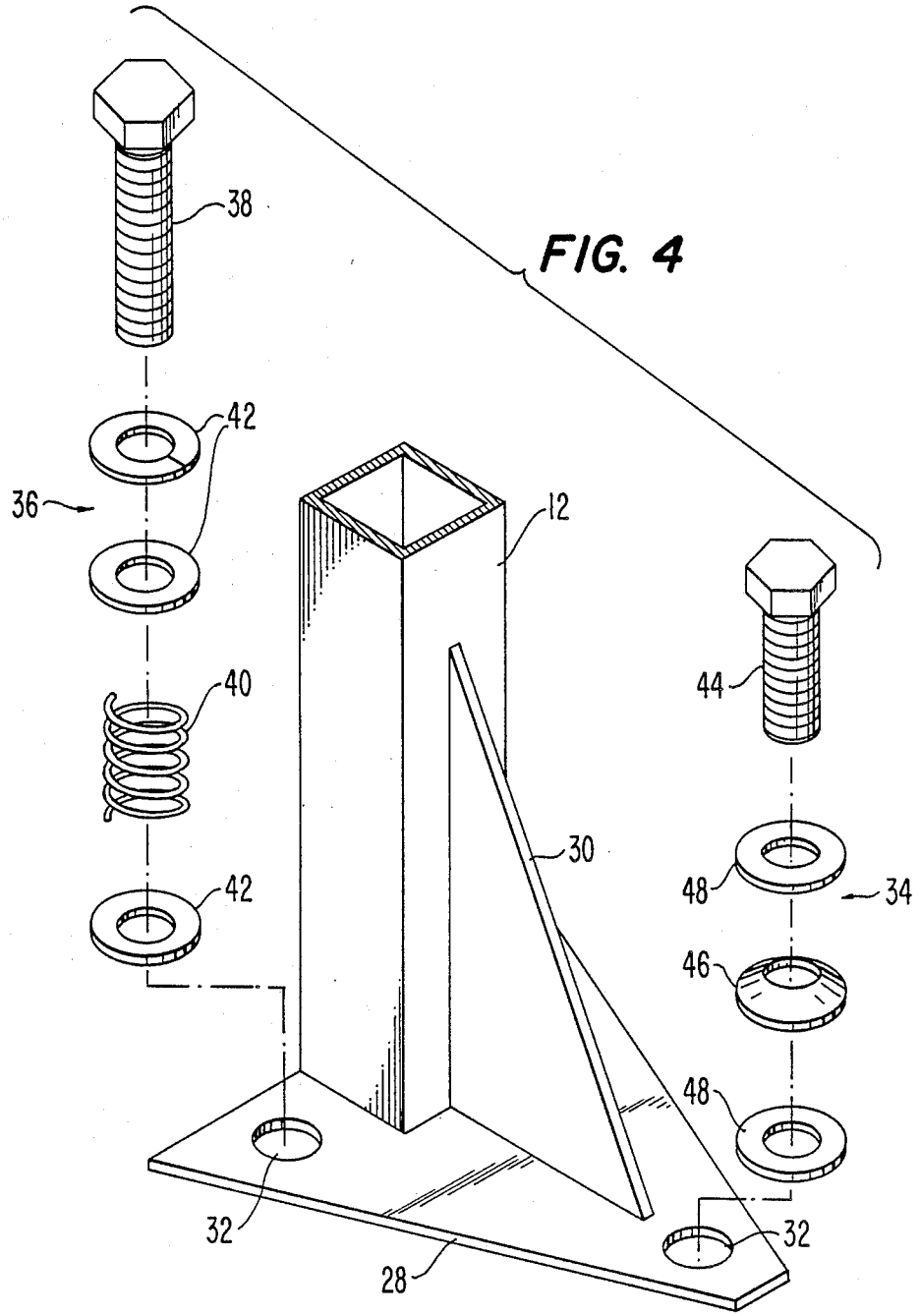
FIG. 4 is an exploded view of the adjustment means of FIG. 3.
Figure 5:
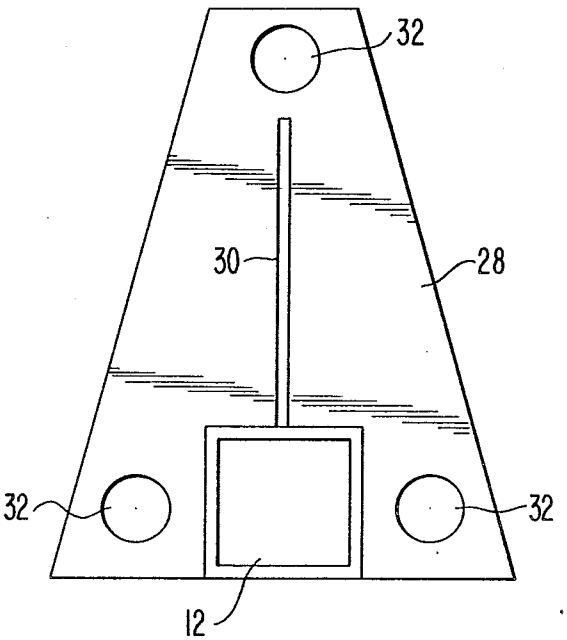
FIG. 5 is a top view of the support and base plate of the system shown in FIG. 1.

As can be clearly seen in FIG. 4, fastener 36 preferably includes bolt 38 with spring 40 surrounding the threaded shaft of the bolt. Additionally, a suitable arrangement of washers 42 can be fitted around the bolt shaft. In this way, as the bolt is tightened, thus compressing the spring, the degree of resilience of the dasher board panels is selectively decreased, i.e., the panel framework becomes less flexible. Conversely, as the bolt is loosened, the spring expands, thus permitting the dasher boards to move more easily. Thus, the flexibility of the dasher board system of the present invention can advantageously be adjusted to accomodate various levels of play.

Figure 7:
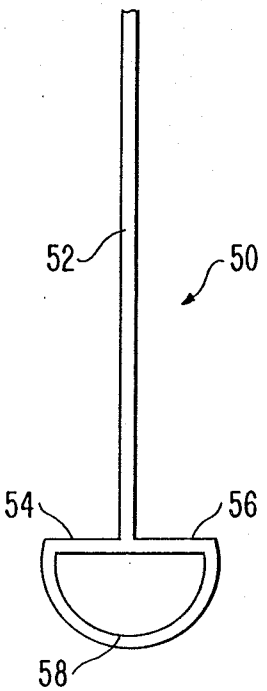
FIG. 7 is a view of the seal gasket shown in FIG. 6.
Figure 6:
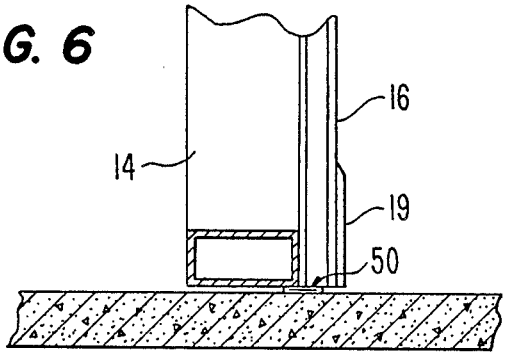
FIG. 6 is a partial cross-sectional view of the frame and seal gasket of the system shown in FIG. 1.

The dasher board system of the present invention preferably includes a seal gasket as shown in FIGS. 6 and 7. Seal gasket 50 is preferably T-shaped having a stem portion 52 and inwardly and outwardly extending flanges 54, 56. The flanges have a rounded cap portion 58. Seal gasket 50 is preferably made of a material that will maintain its flexibility even at low temperatures, such as styrene butadiene or the like.

The stem portion of the seal gasket is placed between the base portion of frame segment 14 and the facing panel 16. Outwardly extending flange 56 is disposed between the rink floor and the frame, while inwardly extending flange 54 is disposed between the rink floor and the facing panel. In this way, the seal gasket provides an efficient, water-tight seal around the base of the dasher boards and permits the rink to be placed on uneven rink substrates.

Figure 9:
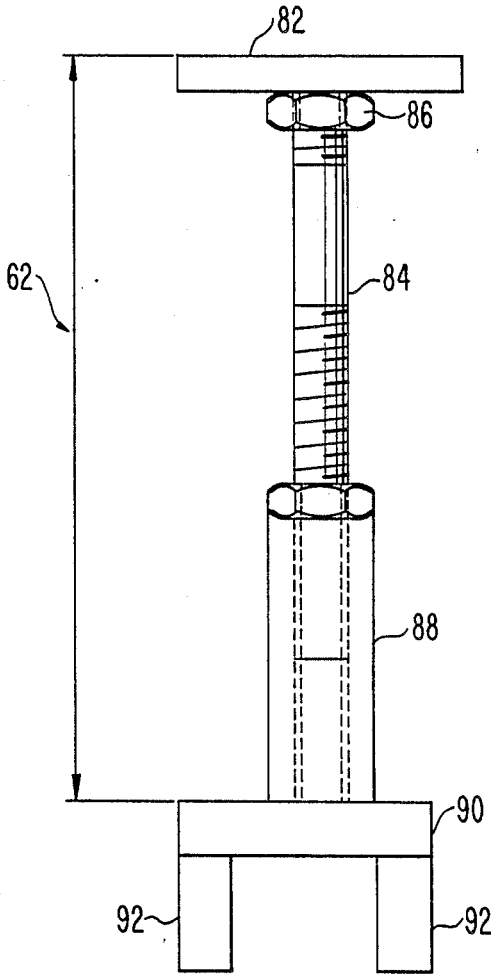
FIG. 9 is a detailed view of the push-button latch mechanism of the door shown in FIG. 8.
Figure 8:
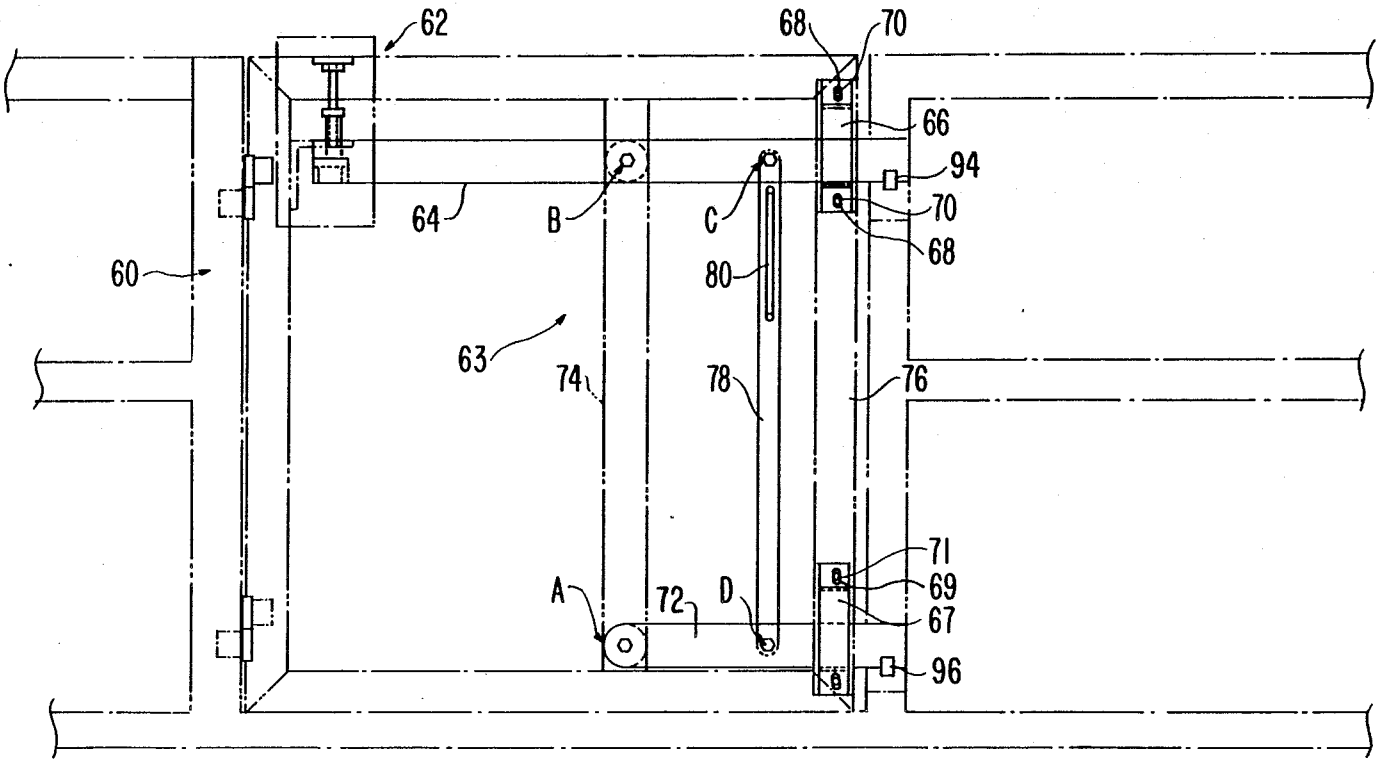
FIG. 8 is a side elevational view of the ice rink door of the system shown in FIG. 1.
Figure 10:
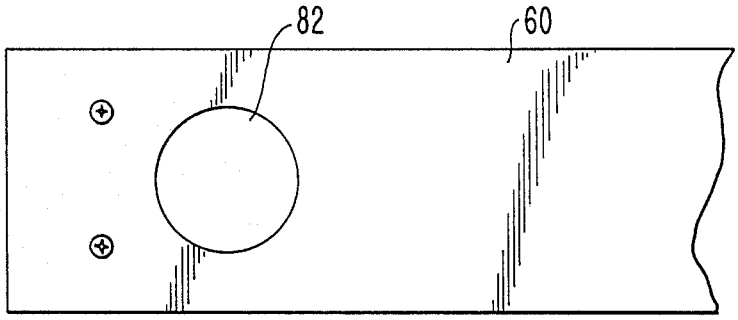
FIG. 10 is a partial top view of the door shown in FIG. 8.

The dasher boards system of the present invention preferably includes door 60 accommodated in an opening between two adjacent frame segments 14. Door 60 is illustrated in FIGS. 8–10 and includes a push-button mechanism 62, which will be described in more detail below. The door is hingedly attached to the ice rink framework in a known manner.

Push-button mechanism 62 is coupled to parallelogram arrangement 63. Parallelogram arrangement 63 includes two substantially parallel lever arms 64, 72 pivotally connected at pivots A and B to two substantially parallel connecting members 74, 76. Connector element 78 extends between lever arms 64, 72 and is also pivotally connected thereto. Handle 80 is connected to connector element 78. All of the various components of the parallelogram arrangement are preferably made from steel or the like.

Figure 11A:
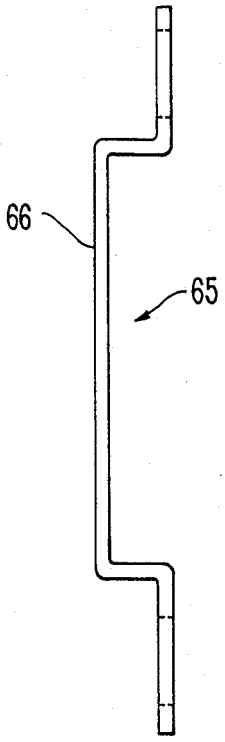
FIG. 11A is a side view of the latch cover plate of the door shown in FIG. 8.
Figure 11B:
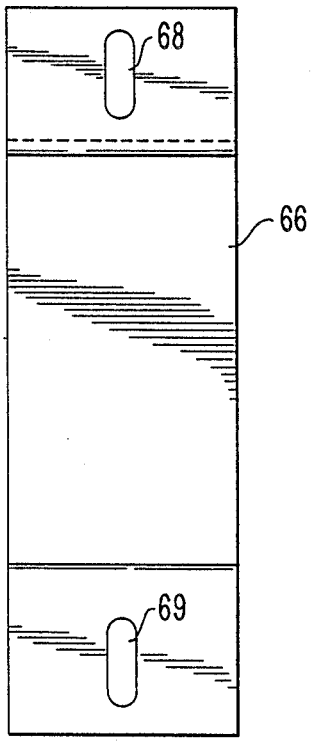
FIG. 11B is a planar view of the latch cover plate shown in FIG. 11A.
Figure 12:
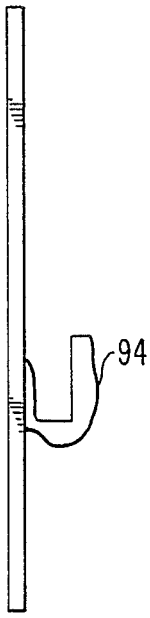
FIG. 12 is a side view of the hook mechanism for latching the door shown in FIG. 8.

On end of lever arm 64 is coupled to push-button mechanism 62. The other end of the lever arm is connected to the door surface via latch cover plate 66. Similarly, one end of lever arm 72 is coupled to the door via second latch cover plate 67. Each cover plate has a raised center portion 65 accommodating the lever arm therethrough, as can be seen in FIG. 11A, so that the lever arm is vertically movable within the raised portion.

Each latch cover plate 66, 67 is preferably formed with two elongated slots 68, 69 for accommodating fasteners 70, 71 therein. The position of the latch cover plates can thus be adjusted during installation, prior to tightening the fastening elements 70, 71.

Push-button latch mechanism 62 includes push-button plate 82 fixed to push rod 84 via nut 86. Push rod 84 is fitted within sleeve 88 so as to be reciprocally movable therein. Sleeve 88 is supported on plate 90 and connectors 92. When push-button plate 82 is in its non-actuated position, the plate is flush with the upper surface of the door. In this way, there are no projections on which a skater might be injured.

Connectors 92 couple the latch mechanism to lever arm 64. Thus, in operation, when push-button plate 82 is depressed, it actuates the push rod so as to move the parallelogram arrangement and release the lever arms 64, 72 from hooks 94, 96.

The door with push-button latch mechanism as in the present invention, advantageously permits the door to be opened from either side of the dasher boards, i.e., from within the ice rink or outside of it. This makes it more convenient for the skaters to exit the ice rink and reduces the potential fire hazard of having skaters trapped within the ice rink.

This description is for illustrative purposes only. Modification can be made, particularly with regard to matters of shape, size and arrangement of parts, within the scope of the invention as defined by the appended claims.

I claim:

1. A dasher board system for an ice rink comprising:
frame segments coupled to form a continuous framework around said ice rink;
facing panels attached to said framework;
a door opening formed between two adjacent frame segments to accommodate a hinged door, said door having a latch mechanism including:
a push-button lock means for releasing said latch mechanism, said lock means being flush with an upper edge of said door when in its non-actuated position and actuatable from either inside or outside of said ice rink;
a lever arm arrangement pivotally coupled to form a parallelogram configuration; and
a hook means for receiving at least one arm of said lever arm arrangement when said door is closed, so that upon actuation of said lock means, said lever arm arrangement pivots to release said at least one arm from said hook means.

2. A dasher board system for an ice rink comprising:
frame segments coupled to form a continuous framework around said ice rink;
facing panels attached to said framework;
a door opening formed between two adjacent frame segments to accommodate a hinged door, said door having a latch mechanism including:
a push-button lock means for releasing said latch mechanism, said lock means being actuatable from either inside or outside of said ice rink;
a lever arm arrangement pivotally coupled to form a parallelogram configuration; and
a hook means for receiving at least one arm of said lever arm arrangement when said door is closed, so that upon actuation of said lock means, said lever arm arrangement pivots to release said at least one arm from said hook means,
wherein said lock means includes a push-button plate fixed to a push rod, and a sleeve coupled to said lever arm arrangement for receiving said push rod, said push rod being reciprocally movable within said sleeve.

3. A dasher board system as in claim 2, further comprising an adjustable shock absorbing anchoring means for anchoring each corresponding frame segment to the ice rink substrate, said anchoring means providing a desired degree of resilience to said dasher board panels.

4. A dasher board system for an ice rink having an ice rink substrate comprising:
a plurality of main supports anchored around the periphery of the ice rink;
a plurality of dasher panel frame segments supported by said main supports and connected together to form a continuous framework around the periphery of the ice rink;
a plurality of dasher board facing panels supported by said continuous framework;
an adjustable shock absorbing means anchoring each of said main supports to the ice rink substrate for providing a desired degree of resilience to said dasher board panels; and
a door opening formed in said framework, and a door accommodated in said opening, said door having a push-button latch means for opening said door when depressed, said latch means being located so that it can be actuated from either side of said door.

5. A dasher board system as in claim 4 wherein said latch means is coupled to a parallelogram lever arm means, said lever arm means being pivotable upon actuation of said push-button latch means.

* * * * *

UNITED STATES PATENT AND TRADEMARK OFFICE

CERTIFICATE OF CORRECTION

PATENT NO. : 4,927,134

DATED : May 22, 1990

INVENTOR(S) : John S. Burley

It is certified that error appears in the above-identified patent and that said Letters Patent is hereby corrected as shown below:

On the face of the patent at box [73] Assignee: change "Ring" to --Rink--.

Signed and Sealed this

Twenty-third Day of July, 1991

*Attest:*

*Attesting Officer*

HARRY F. MANBECK, JR.

*Commissioner of Patents and Trademarks*